US010955212B2

(12) United States Patent
Bowman et al.

(10) Patent No.: US 10,955,212 B2
(45) Date of Patent: Mar. 23, 2021

(54) LIGHTWEIGHT RECOIL MANAGEMENT

(71) Applicant: Eagle Technology, LLC, Melbourne, FL (US)

(72) Inventors: Michael E. Bowman, Satellite Beach, FL (US); Matthew D. Summer, Melbourne, FL (US); Paul M. Bosscher, West Melbourne, FL (US)

(73) Assignee: Eagle Technology, LLC, Melbourne, FL (US)

( * ) Notice: Subject to any disclaimer, the term of this patent is extended or adjusted under 35 U.S.C. 154(b) by 67 days.

(21) Appl. No.: 15/954,220

(22) Filed: Apr. 16, 2018

(65) Prior Publication Data

US 2019/0316863 A1 Oct. 17, 2019

(51) Int. Cl.
*F41A 21/36* (2006.01)
*F42D 5/04* (2006.01)
*F41B 9/00* (2006.01)

(52) U.S. Cl.
CPC ..... *F41A 21/36* (2013.01); *F42D 5/04* (2013.01); *F41B 9/0046* (2013.01)

(58) Field of Classification Search
CPC ..... F41A 21/36; F42D 5/04; F41B 9/0046
USPC ..... 89/14.3
See application file for complete search history.

(56) References Cited

U.S. PATENT DOCUMENTS 3,501,997 A 3/1970 Winsen et al.
3,763,740 A * 10/1973 Fletcher ..... F41F 1/00 89/8
3,783,738 A * 1/1974 Pelat ..... F41A 25/06 89/44.01
4,055,247 A * 10/1977 Benedick ..... F42B 39/14 206/3
4,088,057 A * 5/1978 Nasypany ..... F41C 23/06 89/1.701
4,261,247 A * 4/1981 Reynolds ..... F41A 7/02 185/37
4,476,969 A * 10/1984 Dykema ..... F41A 25/10 188/380

(Continued)

FOREIGN PATENT DOCUMENTS

EP 2 400 255 A2 12/2011
WO 2013/002867 A2 1/2013

OTHER PUBLICATIONS

Li, Z.C., et al., A Gun Recoil System Employing a Magnetorheological Fluid Damper,: Smart Materials and Structures, v. 21, No. 10, 2012. Abstract Only.

(Continued)

*Primary Examiner* — Michelle Clement
(74) *Attorney, Agent, or Firm* — Fox Rothschild LLP; Robert J. Sacco; Carol E. Thorstad-Forsyth

(57) ABSTRACT

A recoil managed disruptor includes a disruptor device having a barrel from which a slug of material is fired. A piston is mechanically coupled to the disruptor device. A housing which supports the disruptor on a positioning device includes a deformable recoil absorber (DRA) constraint. The DRA constraint is configured to receive a sacrificial DRA structure comprised of a semi-rigid material. The piston is responsive to a recoil force produced when the disruptor device is fired to travel along an axial length of the housing and permanently deform the DRA structure within the DRA constraint.

11 Claims, 5 Drawing Sheets

(56) References Cited

U.S. PATENT DOCUMENTS 4,924,751 A * 5/1990 Metz ..... F41A 25/20 188/316
4,957,027 A * 9/1990 Cherry ..... F42B 33/062 86/50
5,014,595 A * 5/1991 Ducolon, Jr. ..... F41A 25/10 89/178
5,105,715 A * 4/1992 Nordmann ..... F41A 25/00 89/36.13
5,194,690 A * 3/1993 Guthrie ..... F41A 1/00 102/307
5,353,681 A * 10/1994 Sugg ..... F41A 25/16 89/177
5,460,154 A 10/1995 Mattern et al.
5,491,917 A 2/1996 Dilhan et al.
5,617,664 A * 4/1997 Troncoso ..... F41A 3/80 124/89
5,746,018 A * 5/1998 Kirschner ..... F41A 21/32 42/1.14
5,811,720 A * 9/1998 Quinnell ..... F41A 23/16 42/94
6,286,408 B1 9/2001 Sanford et al.
6,578,464 B2 * 6/2003 Ebersole, Jr. ..... F41A 25/06 42/1.06
6,745,663 B2 * 6/2004 Ebersole ..... F41A 25/06 42/1.06
6,789,456 B2 * 9/2004 DeRoos ..... F41A 25/06 188/136
6,889,594 B2 * 5/2005 Ebersole, Jr. ..... F41A 25/06 42/1.06
7,836,811 B1 11/2010 Gardner et al.
7,878,105 B2 * 2/2011 More ..... F41A 25/04 89/43.01
7,895,930 B2 * 3/2011 Fisk ..... F41A 25/08 102/402
8,707,846 B2 * 4/2014 Kohnen ..... F41A 1/08 89/1.3
9,134,086 B2 * 9/2015 Lim ..... F41A 25/10
9,217,613 B2 * 12/2015 Langner ..... F41A 25/06
9,435,602 B1 * 9/2016 Tomik ..... F41A 25/10
9,506,728 B2 * 11/2016 Bosscher ..... F41H 11/12
10,215,543 B1 * 2/2019 Benson ..... F42B 3/006
10,240,885 B2 3/2019 Bowman et al.
2004/0079221 A1 * 4/2004 Woods ..... F41A 21/30 89/14.4
2005/0081706 A1 * 4/2005 Alford ..... F42B 33/062 89/1.13
2008/0011152 A1 * 1/2008 Weiss ..... F41A 19/58 86/50
2008/0178508 A1 * 7/2008 Cinciu ..... F41C 23/06 42/1.06
2009/0178548 A1 * 7/2009 Tyas ..... F41B 9/0046 86/50
2011/0000363 A1 * 1/2011 More ..... F41A 25/04 89/43.01
2014/0352568 A1 * 12/2014 Benson ..... F42B 39/002 102/331

OTHER PUBLICATIONS

Hongsheng, H., et al., "Test Modeling and Parameter Identification of a Gun Magnetorheological Recoil Damper," Proceedings of the 2009 IEEE International Conference on Mechatronics and Automation, Aug. 9-12 Changchun, China, 978-1-4244-2693-5/09 copyright 2009 IEEE.

Maravandi, A., et al., "Regenerative Shock Absorber Using a Two-Leg Motion Conversion Mechanism," IEEE/ASME Transactions on Mechatronics, vol. 20, No. 6, Dec. 2015, 1083-4435, copyright 2015 IEEE.

Bowman, M.E., et al., "Shock Absorbing Disruptor Mounting System," U.S. Appl. No. 15/372,070, filed Dec. 7, 2016.

Extended European Search Report dated Sep. 23, 2019, Application Serial No. EP19170037.6 in the name of Eagle Technology, LLC.

* cited by examiner

LIGHTWEIGHT RECOIL MANAGEMENT

BACKGROUND

Statement of the Technical Field

The technical field of this disclosure concerns recoil management, and more particularly concerns lightweight systems and methods that facilitate recoil management.

Description of the Related Art

Certain types of systems are known to produce recoil. These systems can include projectile weapons and also projected water disruptors. Systems that produce recoil can potentially damage support components that are used to carry, position or transport such systems. For example, unmanned ground vehicles (UGVs) used for explosive ordinance disposal (EOD) are often equipped with a projected water disruptor. As is known, conventional projected water disruptors make use of a water-projectile shaped charge to disable explosive devices. The water projectile shaped charge disables the explosive device by separating the trigger mechanism (e.g., timer, battery, fuse) from the main charge faster than the time it takes for these devices to trigger an explosion. Recoil forces produced by a projected water disruptor typically exceed 4000 lbf.

Various systems have been proposed to prevent recoil producing devices from potentially damaging the underlying support systems that are used to carry, position and/or transport the recoil producing device. But many of these systems are not well suited for UGVs or other robotic systems, in part due to the excessive weight and/or bulk that they add to such systems. It is challenging to provide recoil management system that is both light weight and capable of absorbing very large shock impulses.

SUMMARY

A system for managing an impulse force produced by a recoil producing device includes an impulse force coupler. The impulse force coupler is configured to be securely attached to a recoil producing device (RPD) to facilitate indirect transfer of at least a portion of an impulse force produced by the RPD. The system includes a rigid structure which is configured to indirectly receive the portion of the impulse force, and a constraining structure which is configured to removably receive a deformable recoil absorber (DRA) structure having a predetermined size and geometry. At least one air vent can be provided to facilitate the passage of air from an interior portion of the constraining structure which receives the DRA structure.

According to one aspect, the rigid structure can be comprised of a housing which is configured to be interposed between the RPD and a positioning system which supports the RPD. Further, the impulse force coupler can be configured to be fixed to a barrel part of the RPD. The constraining structure is arranged to constrain a deformation of the DRA structure under a condition where the impulse force is indirectly transferred to the rigid structure through the DRA structure.

According to a further aspect, the DRA structure is comprised of a semi-rigid material. The material is permanently deformable so that it will remain in a deformed state after being acted upon by the impulse force. For example, the DRA structure can be comprised of a metal foil. In some scenarios, the DRA structure is comprised of a multiplicity of hollow cells formed of a semi-rigid material. The multiplicity of hollow cells can each comprise a hexagonal shape to define a honeycomb structure.

In some scenarios the housing defines a tubular cavity, and the tubular cavity is configured to facilitate travel therein of the impulse force coupler along at least a portion of an elongated length of the tubular cavity to facilitate the deformation. In such a scenario, the constraining structure can be at least partially defined by at least one interior wall of the tubular cavity. The constraining structure can be further at least partially defined by an exterior surface of the barrel part.

According to one aspect, a barrel part of the RPD can extends though the tubular cavity. In such a scenario, the DRA structure, when received in the constraining structure, at least partially surrounds a part of the RPD. Further, the DRA structure will have an elongated tubular shape which includes a central bore so that a barrel portion of the RPD extends through the central bore when the DRA structure is received in the constraining structure.

The solution also concerns a recoil managed disruptor. The recoil managed disruptor is comprised of a disruptor device having a barrel from which a slug of material is fired. A piston is mechanically coupled to the disruptor device. A housing configured to support the disruptor includes a deformable recoil absorber (DRA) constraint structure. The DRA constraint structure is configured to removably receive therein a sacrificial DRA structure comprised of a semi-rigid material. The piston is responsive to a recoil force produced when the disruptor device is fired to travel along an axial length of the housing and thereby cause a permanent deformation of the DRA structure within the DRA constraint.

The solution also concerns a method for managing recoil of a disruptor device. The method involves securing an impulse force coupler directly or indirectly to a first portion of the disruptor device. A deformable recoil absorber (DRA) structure having a predetermined size and geometry, is removably constrained in a position between a portion of the impulse force coupler and a rigid structure. The rigid structure is secured directly or indirectly to a support structure to facilitate a firing position of the disruptor device. The method continues with a firing operation which involves firing the disruptor to produce an impulse force. Thereafter, at least a portion of the impulse force is transferred to the rigid structure through the DRA structure. This operation produces a permanent deformation of the DRA structure, whereby a portion of the impulse force is absorbed by the DRA structure. The impulse force that is transferred to the rigid structure is modified by the DRA structure with respect to at least one of magnitude and duration.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
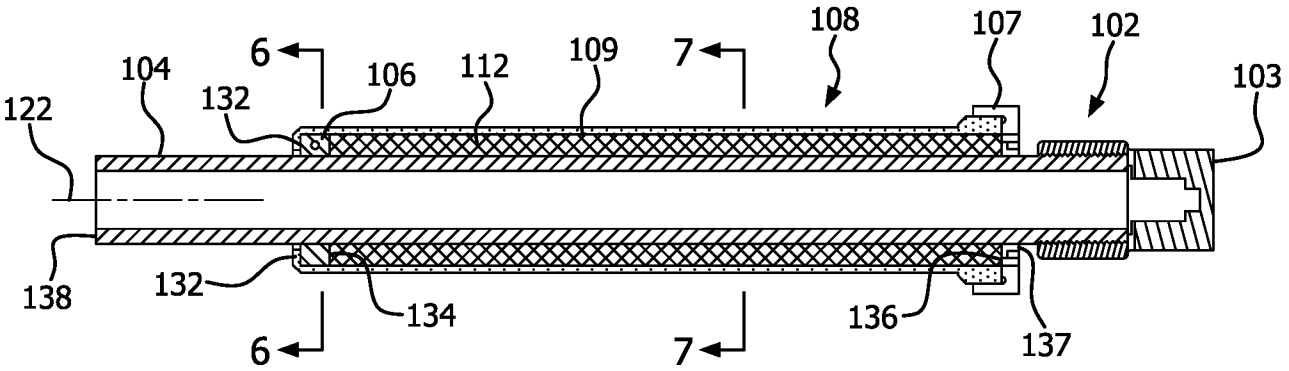
FIG. 1 is a cross-sectional view that is useful for understanding a recoil management system in a first condition, prior to the occurrence of a recoil force.

It will be readily understood that the components of the systems and/or methods as generally described herein and illustrated in the appended figures could be arranged and designed in a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

This disclosure concerns systems and methods for managing an impulse force produced by a recoil producing device. According to one aspect, the systems and methods can involve a recoil managed disruptor device.

A system for managing an impulse force produced by a recoil producing device (RPD) 102 is shown in FIGS. 1-7. In the scenario shown in FIG. 1-7, the RPD is a disruptor device. Disruptor devices are well-known in the art and therefore will not be described in detail. However, it will be appreciated that a conventional disruptor device can include an elongated barrel 104 from which a slug of material can be ejected with explosive force during a firing operation. An impulse force coupler 106 is configured so that it can be securely attached to a part of the RPD which experiences recoil forces. As explained below in greater detail, the impulse force coupler 106 is arranged to facilitate indirect transfer of at least a portion of an impulse force produced by the RPD 102.

A rigid structure 108 is provided to indirectly receive the portion of the impulse force which is transferred by the impulse force coupler 106. According to one aspect, the rigid structure 108 can comprise a housing 109. A system as disclosed herein for managing an impulse force will also include a constraining structure. In some scenarios, a constraining structure can comprise part of the rigid structure 108. For example, in the system which is shown in FIGS. 1-7, the constraining structure is comprised of an internal wall or surface 120 which forms a portion of the housing 109. As explained below, the constraining structure is configured to removably receive a deformable recoil absorber (DRA) structure 112.

A DRA structure 112 will advantageously have a predetermined size and geometry so that it can be received snugly within the constraining structure. When the RPD produces an impulse force 114 the DRA structure 112 serves as an intermediary to at least partially transfer the force to the rigid structure. However, the materials and construction of the DRA structure are advantageous arranged such that it will be at least partially deformed or crushed while serving to facilitate the force transference operation described herein. This deformation or crushing action can be observed by comparing FIGS. 1 and 2.

Figure 2:
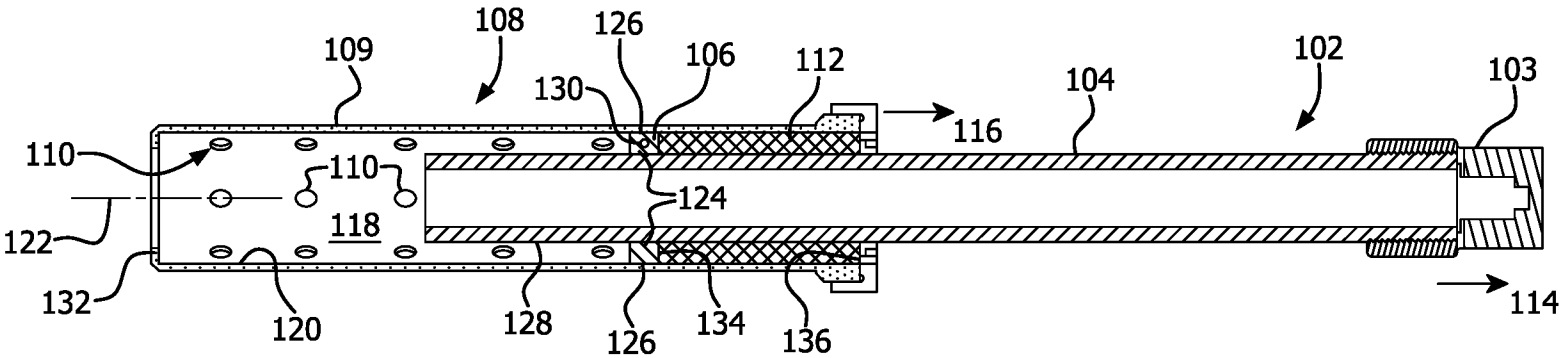
FIG. 2 is a cross-sectional view that is useful for understanding a recoil management system of FIG. 1 in a second condition, after the occurrence of a recoil force.

In FIG. 1 the DRA structure 112 is not deformed and has not yet transferred the impulse force to the rigid structure. In FIG. 2, the DRA structure 112 is deformed as a result of the force transference operation. The constraining structure is arranged to at least partially constrain a deformation of the DRA structure under such force transference operation so that the DRA structure 112 is deformed or crushed in a controlled and predictable manner. From the foregoing it will be understood that the DRA structure 112 is designed to be a sacrificial component. The DRA structure 112 can be disposed of and/or replaced after it has served the function of absorbing and changing the characteristics of the impulse force from the RPD 102.

The deformation or crushing of the DRA structure 112 as disclosed herein will absorb as heat a portion of the energy associated with the impulse force 114 that is produced by the RPD recoil action. The deformation of the DRA structure 112 will also serve to convert the high-force short duration impulse force 114 from the RPD 102 to a lesser magnitude force 116 having a longer duration. Accordingly, the peak magnitude of force 116 that is actually transmitted to the rigid structure is reduced as compared to a scenario where the impulse force 114 is communicated directly to the rigid structure. Changing the force characteristics in this way can prevent potential damage to a supporting structure that is used to position the RPD.

Many RPDs, such as a disruptor device, can be comprised of an elongated tubular barrel 104 which is used to explosively eject a slug of some type of material, such as water. Accordingly a recoil management system disclosed herein can in some scenarios be fitted directly on the barrel 104 of such devices. Such an arrangement is illustrated in FIGS. 1-7 which shows that a housing 109 can be comprised of an elongated tubular construct. The elongated tubular construct will have an internal bore 118 which extends along an axis defined by an elongated length of the housing 109. The tubular construct can be at least partially defined by an interior wall 120 of the housing 109.

Figure 3:
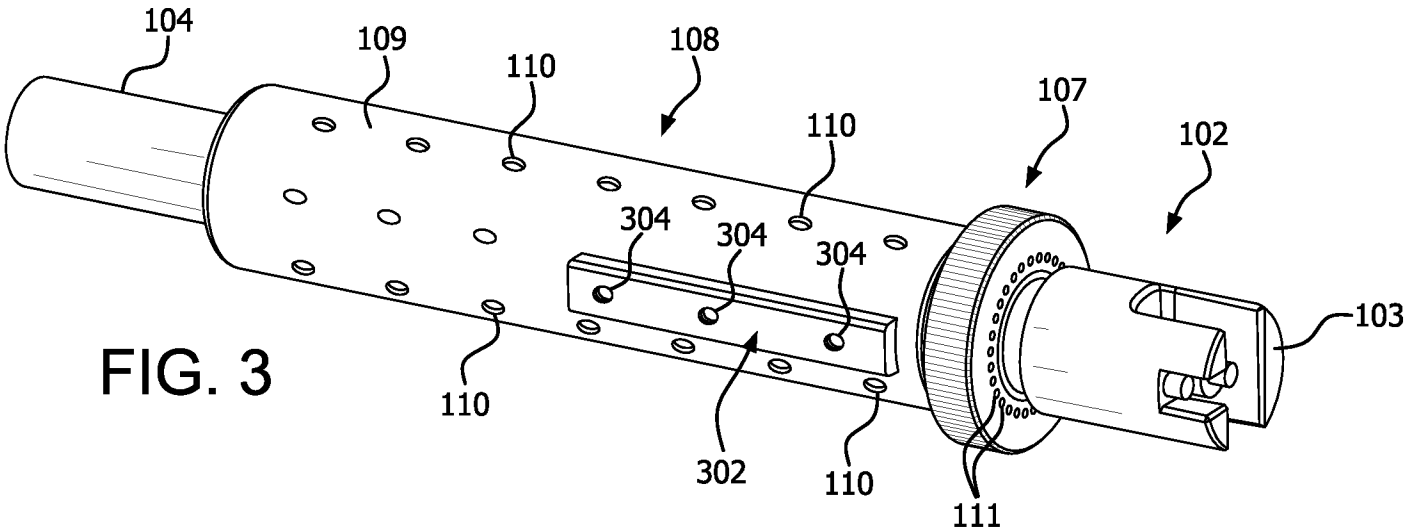
FIG. 3 is a perspective view that is useful for understanding the recoil management system of FIG. 1 in the first condition.
Figure 4:
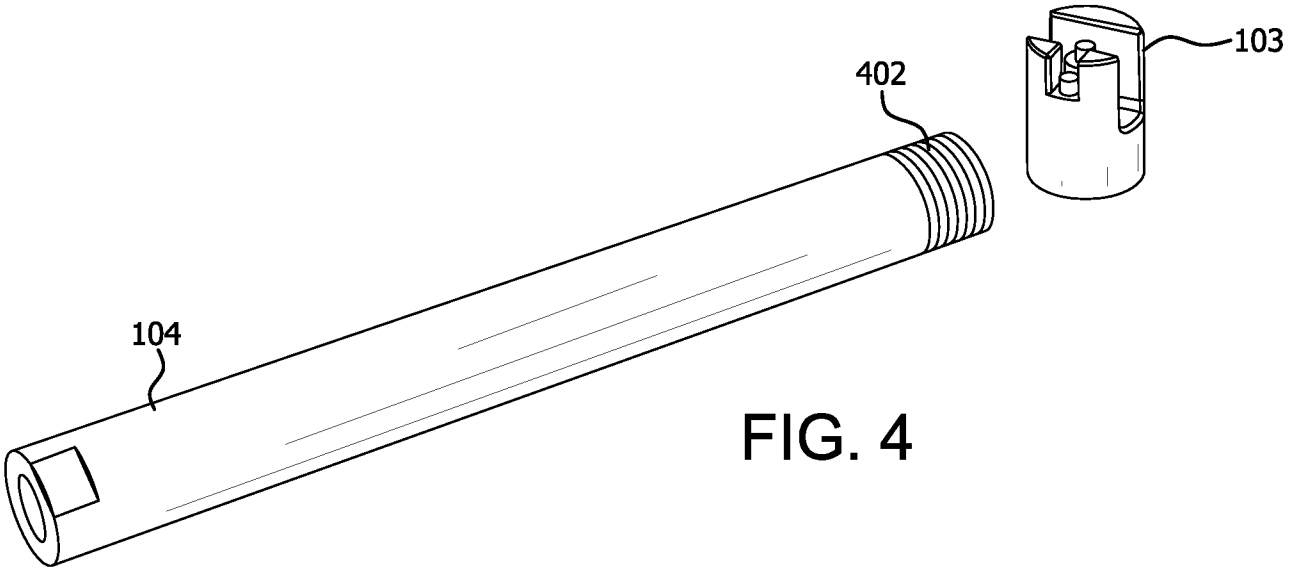
FIG. 4 is a perspective view which is useful for understanding a disassembly process for an RPD device which facilitates removal of a DRA structure.

The elongated length of the tubular construct can be configured to extend at least partially over the length of the barrel 104 as shown in FIGS. 1-3. Accordingly, a part of the RPD such as the barrel 104 can be received in the elongated internal cavity 118. It can be observed in FIGS. 1 and 2 that the barrel 104 can be positioned within the housing so that the barrel axis is aligned with bore axis 122 to facilitate a coaxial configuration. As explained below in further detail, the housing 109 will be attached to a support or positioning structure so that it remains in a substantially fixed position. With the foregoing arrangement, the barrel can under certain conditions travel or move a limited distance relative to the housing. This travel will be along at least a portion of the internal bore 118, in a direction aligned with axis 122 and is best understood by comparing FIGS. 1 and 2.

In FIG. 1, the barrel 104 is in a first position relative to the housing 109 prior to the disruptor 102 being fired. In FIG. 2, the barrel 104 is in a second position relative to the housing 109. The second position shows the relative position of the barrel 104 and the housing 109 after the disruptor 102 has been filed. In the second position, the barrel 104 has traveled a distance through internal bore 118 along axis 122. This travel results in a permanent deformation or crushing of the DRA structure 112.

In some scenarios, the internal surface 120 which defines the elongated internal bore 118 can also define at least a portion of the constraining structure. The internal bore 118 of the tubular construct can have a cylindrical configuration as shown. According to one aspect, the housing 109 which comprises the rigid structure 108 can be configured as a hollow tubular canister formed of a cylindrically shaped wall 120. However, it should be appreciated that the solution is not so limited and other bore configurations are also possible. For example, rather than have a circular cross-section to define a cylinder as shown, the internal bore could have a square, rectangle or polygon shaped internal bore.

In the scenario shown in FIGS. 1-6, the impulse force coupler 106 is comprised of a toroidal-shaped piston ring. As such, the impulse force coupler 106 can have a central bore 124 which is configured to fit snugly over the outer surface 128 which defines the barrel 104. The piston ring has an outer peripheral surface 126 which can be configured to snugly fit within the interior bore 118 as shown. In some scenarios, the profiled shape defined by the outer peripheral surface 126 of the piston ring can be selected to conform to the shape of the interior bore 118. For example, if the interior bore 118 has a cylindrical shape as shown, then the outer peripheral surface 126 can also be cylindrical. Similarly, the central bore 124 can define a profiled shape which is conformed to the outer surface 128 of the barrel 104. The piston ring can also include a crush face 134 which is configured to engage the DRA structure 112 in a crushing action when the disruptor 102 has been fired.

In some scenarios, the toroidal-shaped piston ring type of impulse force coupler 106 can be permanently fixed to the barrel. In other scenarios, the impulse force coupler is configured so that it can be removably secured to the barrel 104. For example, in some scenarios, an impulse force coupler 106 as described herein can be attached to the barrel 104 by means of a clamping action with the help of a suitable fastener (e.g., a threaded screw) 130. Such a configuration can be advantageous to allow the impulse force coupler 106 to be retrofitted to an existing barrel 104.

In an exemplary arrangement, the housing 109 can include a removable cap plate 107, which is removably secured to the housing by suitable means. For example, in some scenarios, the cap plate can be threaded onto an end of the housing 109 as is shown in FIGS. 1 and 2. Vent holes can be provided in the housing. These vent holes can include vent holes 110 which are provided in the body of the housing 109 and/or vent holes 111 provided in the cap plate 107. As explained below in further detail, the purpose of these vent holes is to allow air to escape from the internal space 118 to an external environment during a period after the disruptor is fired, and when the impulse force coupler is crushing or deforming the DRA structure.

The housing 109 also has a lip 132 disposed at an end of internal bore 118 opposed from the cap plate 107. In some scenarios, the lip can extend circumferentially around the internal bore 118. The purposes of the lip 132 is to limit the travel barrel 104 with respect to the housing 109 along the axial direction 122, so that the impulse force coupler 106 and attached barrel cannot slide past the lip. Consequently, with the DRA structure 112 removably captured between the cap plate 107 and the lip 132, the housing is securely fixed to the barrel 104. The DRA structure 112 is a semi-rigid structure so that relative travel of the barrel with respect housing 109 is prevented, except when the disrupter is fired. Further, the DRA structure, when received in the constraining structure, at least partially surrounds a part of the RPD (in this case, the barrel 104).

With the foregoing arrangement, it can be observed in FIGS. 1-2 that deformation of the DRA structure takes place along an axial direction 122, but is constrained in directions transverse to the axial direction. The constraining is partially facilitated by the interior wall 120 which defines the internal bore 118 of the housing 109. The deformation in some scenarios is further constrained by the exterior surface 128 of the barrel 104, which extends through an inner axial bore of the DRA structure, aligned with axis 122.

The DRA is retained by a retention lip 136 defined by the cap plate 107 and a crush face 134 of the impulse force coupler 106. The DRA structure 112 is snugly fitted in the cylindrically-shaped interstitial space provided between the barrel and the interior wall 120. As such, when the disruptor 102 is fired, the DRA structure 112 will be crushed or deformed in the axial direction 122 between the crush face 134 and the retention lip 136. But the DRA structure 112 will be constrained with respect to such deformation by interior wall 120 and by the barrel exterior surface 128. Accordingly, deformation of the DRA structure will be prevented in directions not aligned with the axial direction. These constraining structures ensure consistent and controlled deformation of the DRA structure in response to known recoil forces.

Figure 5:
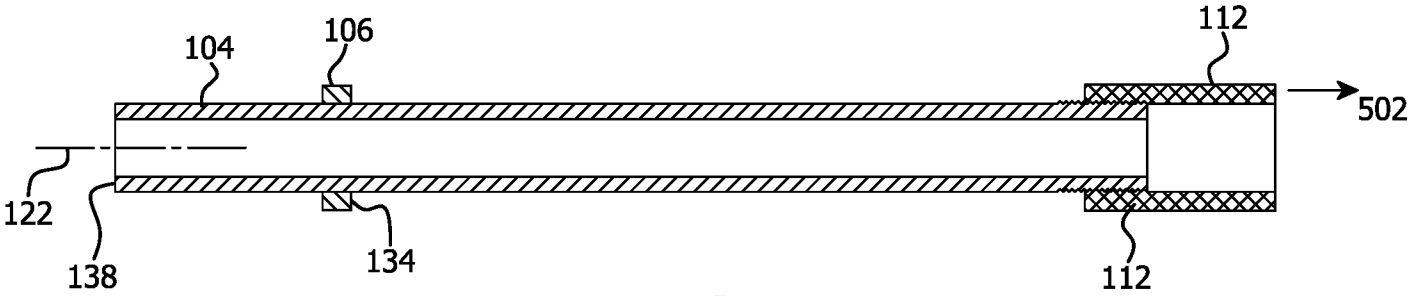
FIG. 5 is a drawing that is useful for understanding how a DRA structure can be removed and replaced from a barrel of a recoil producing device.
Figure 7:
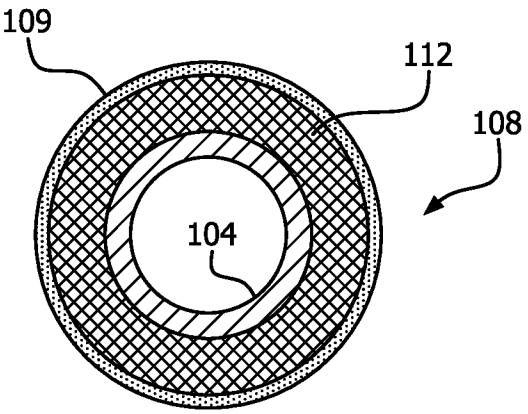
FIG. 7 is a cross-sectional view of the recoil management system in FIG. 1, taken along line 7-7.
Figure 6:
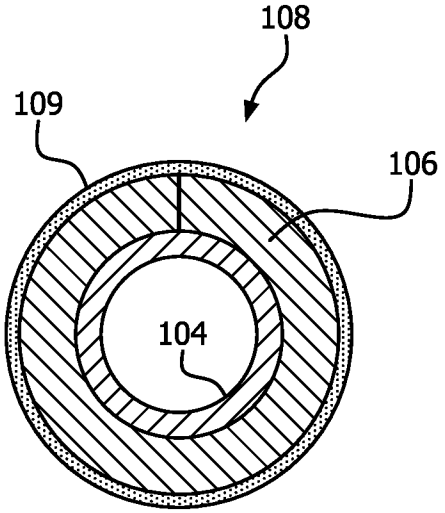
FIG. 6 is a cross-sectional view of the recoil management system of FIG. 1, taken along line 6-6.

After the disruptor is fired and the DRA structure has been deformed, the DRA structure can be removed from the housing 108. This process can be facilitated by removing the cap plate 107, and sliding the housing off the barrel 104 so that the DRA structure 112 is at least partially exposed as shown in FIG. 5. The rear portion 103 of the disruptor 102 can then be removed from the barrel as shown in FIG. 5. This rear portion 103 is conventionally threaded onto an end portion 402 of the barrel 104, and is typically removed after each shot in order to re-load the disruptor with a slug of material (e.g., water). With the rear portion 103 removed, the deformed DRA structure 112 can be freely removed from the barrel 104 by sliding the DRA structure in the direction indicated by the arrow 502.

In an alternative scenario, the impulse force coupler 106 can be temporarily unclamped or removed from the barrel 104, after which the DRA structure 112 can be slid off the end 138 of the barrel 104 in a direction opposite to that which is shown in FIG. 5. In either case, installation of a new DRA structure involves reversing these steps so that the unit is once again ready to be fired.

Figure 8:
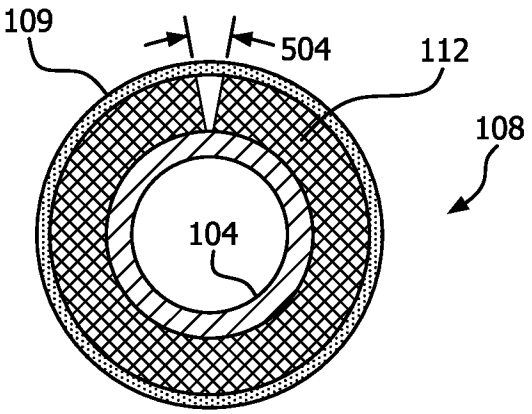
FIG. 8 is a cross-sectional view that is useful for understanding a DRA structure having an elongated slit along its axis to facilitate removal from a barrel of an RPD.

In some scenarios, it may be desirable to remove the DRA structure 112 without removing disruptor end portion 103 and/or impulse force coupler 106. In such scenarios, the removal process can be facilitated by forming the DRA structure with at least one slit or a gap extending along its elongated length so that the DRA structure can be more easily stripped from the barrel. FIG. 8 shows a DRA structure with one gap 802. The slit or gap 802 can extend over a relatively small angle (e.g., less than 10 degrees of arc). However, in other scenarios, the slit or gap can extend over a relatively larger angle (e.g., between 10 degrees and 30 degrees of arc).

Figure 9:
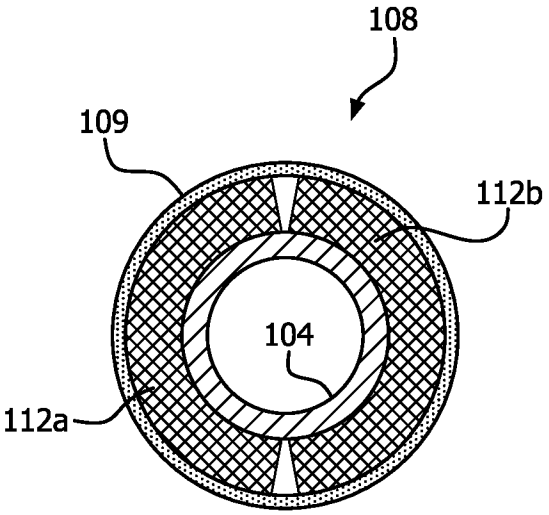
FIG. 9 is a cross-sectional view that is useful for understanding a two-part DRA structure.

In other scenarios, the DRA structure can be comprised of two or more parts 112*a*, 112*b*, as shown in FIG. 9. In such scenarios each part 112*a*, 112*b* can extend at least partially around an exterior periphery of the barrel 104 as shown. Consequently, the DRA structure can be easily removed from opposing sides of the barrel 104 following the deformation operation.

The rigid structure 108 is configured so that it can be mounted to a positioning system which is designed to support the RPD. For example, rigid structure 108 can include a mounting face 302 as shown in FIG. 3. The mounting face is configured to facilitate attachment of the housing 109 to a disruptor support or positioning system. One or more threaded holes 304 can be provided in the mounting face 302 to facilitate this attachment. With the foregoing arrangement, housing 109 can be conveniently attached to a positioning system.

It will be appreciated that a positioning system that is used to support an RPD 102 can be any of a wide variety of systems and structures. For example, the supporting structure can be relatively simple mechanical system comprising a base be arranged so that it forms a stable platform when placed on the ground. The base can have mounted thereto a jointed mechanical arm. The arm can include one or more movable joints which are manually reconfigurable to allow the mechanical arm to be set to a particular pose which is desired by a user to facilitate use of an RPD. In other scenarios, the supporting structure can comprise a robotic arm which includes a plurality of actuated joints that allow one or more segments of the arm to be positioned using a control system. In some scenarios, a robotic arm as described can be disposed on an unmanned ground vehicle (UGV).

Figure 10:
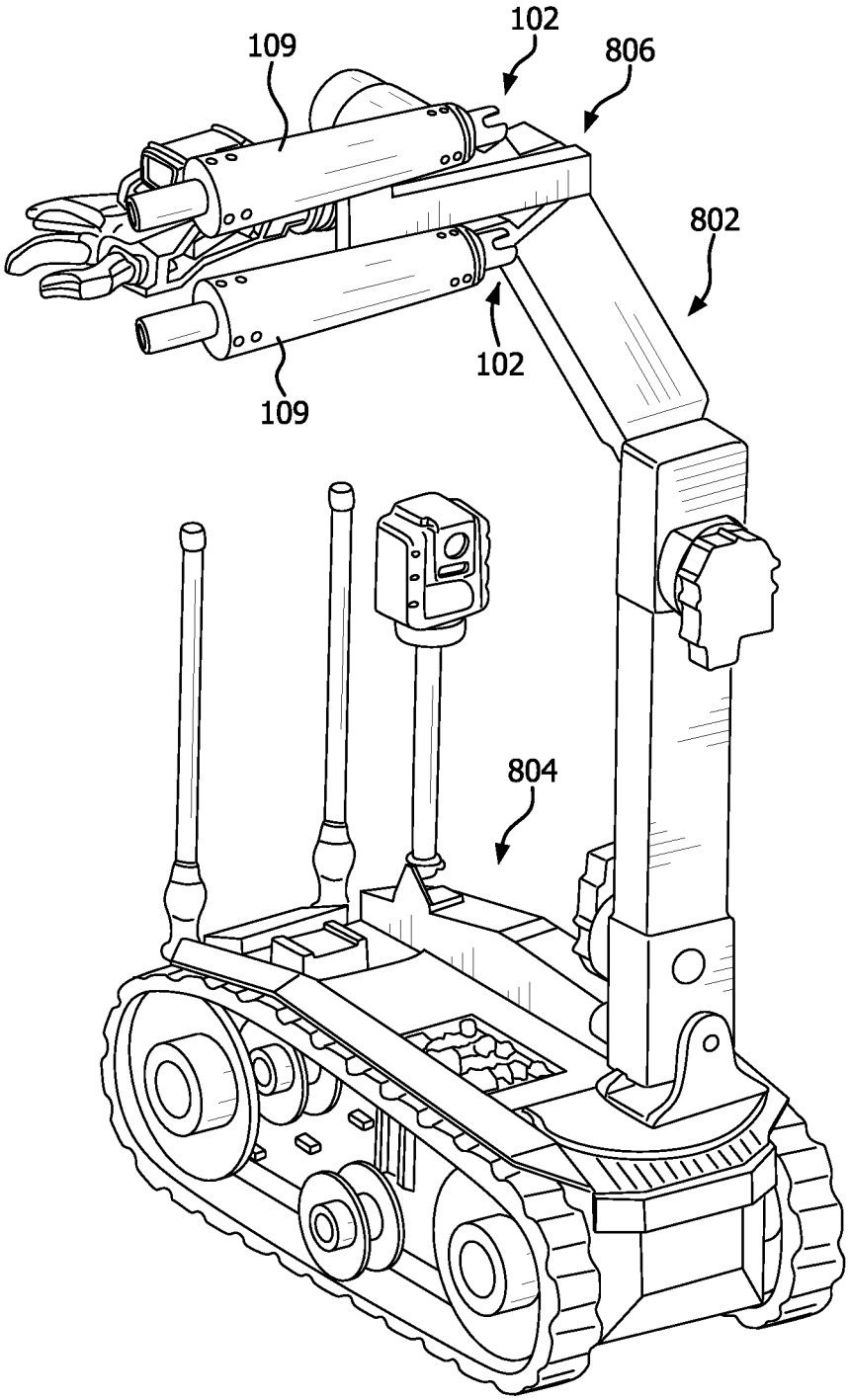
FIG. 10 is a drawing that is useful for understanding a mounting configuration of a recoil management system.

Such a scenario is illustrated in FIG. 10 which shows a pair of disruptors 102 disposed in housing 109 and secured to a robotic arm positioning system 802 of UGV 804. The housing 109 is securely attached to the robotic arm positioning system 306, with a mounting bracket 806. The mounting bracket 806 is fixed to a portion of the robotic arm positioning system 802 and is attached to the housing 109 (e.g., by means of the mounting face 302). Threaded screws or some other type of suitable fastener can be used for this purpose.

It will be appreciated that with the arrangement as shown and described with respect to FIG. 10, the rigid structure defined by the housing 109 is interposed between each of the disruptors 102 and the robotic arm positioning system 802. Accordingly, recoil forces from the disruptors 102 are not coupled directly to the robotic arm, but are instead communicated to the robotic arm through the rigid structure defined by the housing 109. Further, the characteristics of such recoil forces will be modified advantageously in accordance with the recoil management system disclosed herein.

The DRA structure 112 is advantageously comprised of a semi-rigid material which is configured to remain in a deformed state after being acted upon by the impulse force. In some scenarios, the DRA structure is comprised of a metal foil material which is configured to crush or deform in response to the firing of the disruptor. The exact configuration of the DRA structure is not critical provided that it achieves a desired level of energy absorption and adequately transitions the recoil force from a short duration large magnitude force, to a longer duration, lesser magnitude force. However, it has been determined that certain structures can be particularly well suited for carrying out this purpose. For example, in some scenarios the DRA structure is comprised of a multiplicity of hollow cells formed of a semi-rigid material (such as metal foil). According to one aspect, the multiplicity of hollow cells can be formed so that each cell comprises a hexagonal shape to define a honeycomb structure. An advantage of these types of structures are that they are relatively strong and lightweight. The alignment direction of each cell can be along the direction of the axis 122. Of course, other DRA structure types are also possible and the solution disclosed herein is not intended to be limited in this regard.

From the foregoing it will be understood that the solution can in some scenarios concern a recoil managed disruptor, where the disruptor device includes a barrel from which a slug of material is fired. In such scenarios, an impulse force coupler 106 can be thought of as functioning in the manner of a piston. In this context, the piston is responsive to a recoil force produced when the disruptor device is fired. This recoil force causes the piston to travel along a length of a canister or housing 109 where it crushes the DRA structure within the constraining structure (e.g., inner housing wall 120 and outer barrel wall 128). The housing 109 is configured to facilitate relative travel of the disruptor barrel 104 through the housing along a recoil axis 122 when the disruptor device 102 is fired. For example, such travel can be facilitated by a bushing 137 which guides the barrel as it travels through the housing. In a scenario described herein, the barrel is also guided along the length of the housing by the outer peripheral face 126 of the force coupler 106.

A recoil management system as described herein can be particularly compact and lightweight because the constraining structure is simple, and the DRA structure extends snugly around at least a portion of the barrel 104 when received in the DRA constraining structure. In an exemplary arrangement, an impulse force coupler serves multiple functions. For example, it guides the barrel as it travels along the length of the housing 109, it helps secure the housing to the barrel, it couples the impulse or recoil forces to the DRA structure, and it provides the crush face which is used to actually deform the DRA structure. Similarly, the disruptor barrel is used as a part of the constraining structure, aided by the cylindrical canister housing 109

The solution disclosed herein also concerns a method for managing recoil of a disruptor device 102. In this regard, the method can involve securing an impulse force coupler 106 directly or indirectly to a first portion of the disruptor device 102 (e.g., a first portion of the barrel). The method can further involve removably constraining a DRA structure as described herein, where the DRA has a predetermined size and geometry. The DRA structure is retained during a disruptor firing operation in a position between a portion of the impulse force coupler (e.g., impulse force coupler 106) and a rigid structure (e.g., housing 109, cap plate 107).

The method can further involve securing the rigid structure directly or indirectly to a support structure (e.g. a robotic arm 802) to facilitate a firing position of the disruptor device. The disruptor is then fired to produce an impulse or recoil force, and at least a portion of the impulse force is transferred to the rigid structure (e.g., housing 109) through the DRA structure 112. This operation can involve the barrel 104 traveling through a portion of the housing during the force transference process. This travel causes an impulse coupling device 106 to crush the DRA structure, thereby producing a permanent deformation of the DRA structure. Consequently, a portion of the impulse force is absorbed by the DRA structure and the characteristics of the impulse force are modified before they are transferred to the rigid structure.

In the method disclosed herein the DRA structure 112 is at least partially constrained by the rigid structure of housing 109. Further, it will be appreciated that the DRA structure 112 is at least partially constrained during the deformation process by a second portion of the disruptor device (e.g., a second part of the barrel 104). As will be understood from the foregoing discussion the first and second portion of the disruptor device referenced herein can be both selected to be a portion of a barrel of a disruptor device from which a slug of material is ejected.

The solution disclosed herein is advantageous because it is simple, lightweight, inexpensive and effective. The housing 109 can be a simple cylindrical canister with a threaded end for receiving the cap plate 107. The cylindrical canister can be formed of a strong, lightweight material such as a metal or fiber reinforced polymer. The system has no moving parts to fail or wear out. The sacrificial element (i.e., the DRA structure) can be quickly replaced after each firing operation. Moreover, the system can be retrofitted to existing disruptors with minimal effort. It can be used with any type of RPD, and different types of DRA structures having different deformation characteristics can be used in different circumstances.

In some scenarios, the housing 109 can be comprised of a canister or other type of structure which is configured to enclose all or part of the DRA structure. When the piston or impulse force coupler 106 travels along a length of the housing to crush the DRA structure, it can potentially result in compression of air within the housing in the space where the DRA structure is constrained. If not addressed, this pressure build-up can adversely affect the force modification function facilitated by the DRA structure. In such scenarios, an excessive amount of force can be transmitted from the housing to the supporting or positioning structure. Accordingly, vent holes are advantageously provided in portions of the constraining structure. In the example shown in FIGS. 1-3, these vent holes include vent holes 110 which are provided in the body of the housing 109. Similarly, vent holes 111 can be provided in the cap plate 107. The vent holes define air passages which extend between internal space 118 and an ambient environment surrounding the housing. As such, the vent holes allow air to escape from the internal space 118 to an external environment during a period after the disruptor is fired, and when the impulse force coupler is crushing or deforming the DRA structure.

As is known, a projected water disruptor mounted to a robotic arm of a UGV can be well suited for allowing EOD personnel to disable an explosive device while remaining a safe distance from a potentially dangerous explosive device. Projected water disruptors make use of a water-projectile shaped charge to disable explosive devices. The water projectile shaped charge disables the fuse and/or anti-tampering device of the explosive device faster than the time it takes for these devices to trigger an explosion. Recoil forces produced by a projected water disruptor typically exceed 4000 lbf. Accordingly, the recoil management system disclosed herein can be advantageously used or combined with a conventional projected water disruptor. In such a scenario, the barrel 104 would be one that is configured to explosively eject a slug of water. However, it should be appreciated that a disruptor 102 as referenced herein is not limited to a projected water disruptor. Instead, a disruptor include devices which are capable of ejecting projectile a wide variety of slugs comprised of various different material types. Further it should be understood that a disruptor device is merely one example of an RPD which is contemplated for use with the solution presented herein.

Furthermore, the described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A system for use with a recoil producing device, comprising:

an impulse force coupler capable of being securely attached to the recoil producing device (RPD) to facilitate, when attached to the RPD, indirect transfer of at least a portion of an impulse force produced by the RPD during a first firing operation;

a rigid structure sized and shaped to removably receive the impulse force coupler, and provided to indirectly receive the portion of the impulse force which is transferred by the impulse force coupler when the impulse force coupler is caused to slide within the rigid structure in a direction of the impulse force;

a sacrificial deformable recoil absorber (DRA) structure that is configured to be at least partially permanently deformed by the impulse force coupler while serving to change at least one characteristic of the impulse force, and that is configured to transfer the impulse force with the at least one changed characteristic to the rigid structure;

a constraining structure in which the sacrificial DRA structure is removably received such that the sacrificial DRA structure is able to be replaced by another sacrificial DRA structure after experiencing permanent deformation and prior to a second firing operation being performed by the RPD; and a cap removably coupled to rigid structure to allow the sacrificial DRA structure to be inserted in and removed from the constraining structure;

wherein at least one vent hole is formed in the constraining structure so as to define an air passage extending between an internal space of the system and an ambient environment surrounding the system;

wherein the sacrificial DRA structure at least partially blocks air from flowing through the at least one vent hole to the ambient environment when the sacrificial DRA structure is in an undeformed state, and no longer blocks the air from flowing through the at least vent hole to the ambient environment when the sacrificial DRA is in a deformed state.

2. The system according to claim 1, wherein the sacrificial DRA structure is comprised of a metal foil.

3. The system according to claim 1, wherein the sacrificial DRA structure is comprised of a multiplicity of hollow cells formed of a semi-rigid material.

4. The system according to claim 3, wherein the multiplicity of hollow cells each comprise a hexagonal shape to define a honeycomb structure.

5. The system according to claim 1, wherein the rigid structure is comprised of a housing with a coupler that is configured to mount the system on a positioning system of the RPD.

6. The system according to claim 1, wherein the impulse force coupler is able to be coupled to a barrel part of the RPD.

7. The system according to claim 6, wherein a housing defines a tubular cavity, and the tubular cavity is configured to facilitate travel therein of the impulse force coupler along at least a portion of an elongated length of the tubular cavity to facilitate the deformation.

8. The system according to claim 7, wherein the constraining structure is at least partially defined by at least one interior wall of the tubular cavity.

9. The system according to claim 6, wherein the impulse force coupler is sized and shaped to receive the barrel part of the RPD such that the barrel part extends through the tubular cavity when the system is used with the RPD.

10. The system according to claim 1, wherein the sacrificial DRA structure is sized and shaped to at least partially surround a part of the RPD when (i) the system is being used with the RPD system and (ii) the sacrificial DRA structure is received in the constraining structure.

11. The system according to claim 10, wherein the sacrificial DRA structure has an elongated tubular shape which includes an elongate central bore sized and shaped to receive a barrel portion of the RPD.

* * * * *